US005958667A

United States Patent [19]

Deroover et al.

[11] Patent Number: 5,958,667

[45] **Date of Patent: *Sep. 28, 1999**

[54] PHOTOTHERMOGRAPHIC RECORDING MATERIAL COMPRISING IR-SENSITIZING DYES

[75] Inventors: Geert Deroover, Kessel-Lo; Paul Callant, Edegem; Herman Uytterhoeven, Bonheiden, all of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/889,484

[22] Filed: Jul. 8, 1997

Related U.S. Application Data

[60] Provisional application No. 60/027,501, Sep. 27, 1996.

[30] Foreign Application Priority Data

Jul. 24, 1996 [EP] European Pat. Off. ..... 96202101

[51] Int. Cl.[6] ..... G03C 1/20; G03C 1/498

[52] U.S. Cl. ..... 430/584; 430/573; 430/588; 430/619; 430/944

[58] Field of Search ..... 430/588, 584, 430/944, 573, 619

[56] References Cited

U.S. PATENT DOCUMENTS

| | | | |
|---|---|---|---|
| 4,873,184 | 10/1989 | Simpson . | |
| 5,223,389 | 6/1993 | Matsunaga et al. | 430/576 |
| 5,364,755 | 11/1994 | Miyamoto et al. | 430/584 |
| 5,422,234 | 6/1995 | Bauer et al. | 430/619 |
| 5,424,174 | 6/1995 | Motokazu et al. | 430/619 |
| 5,424,182 | 6/1995 | Marginean, Sr. et al. | 430/617 |
| 5,541,054 | 7/1996 | Miller et al. | 430/619 |

FOREIGN PATENT DOCUMENTS

| | | |
|---|---|---|
| 0486246 | 5/1992 | European Pat. Off. . |
| 0559228 | 9/1993 | European Pat. Off. . |
| 0587338 | 3/1994 | European Pat. Off. . |
| 0609571 | 8/1994 | European Pat. Off. . |
| 58-028737 | 2/1983 | Japan . |
| 63-023145 | 1/1988 | Japan . |

OTHER PUBLICATIONS

P.W. Lauf, "Photothermographic Silver Halide Systems" *Research Disclosure*, No. 299, Mar. 1989, Havant GB.

J.A. Verdone, "Polymeric Binders for Photothermogrphic Materials" *Research Disclosure*, No. 186, Oct. 1979, Havant GB.

English Translation of JP 63 023 145 Fuji Photo Film KK Jan. 1988.

English Translation of JP 58 028 737 Konishiroku Photo KK Feb. 1983.

*Primary Examiner*—Thorl Chea

*Attorney, Agent, or Firm*—Baker & Botts, L.L.P.

[57] ABSTRACT

A photothermographic recording material comprising a support and a photo-addressable thermally developable element containing a substantially light-insensitive organic silver salt, a reducing agent therefor in thermal working relationship therewith, photosensitive silver halide spectrally sensitized to wavelengths >700 nm with a dye and in catalytic association with the substantially light-insensitive organic silver salt and a water-soluble binder, a water-dispersible binder or a mixture of a water-soluble and a water-dispersible binder, characterized in that the photothermographic recording material has an infra-red sensitivity of less than 80 J/m$^2$ and the dye satisfies the following test: an exposure required by a photothermographic recording material A, consisting of a polyester 100 $\mu$m thick support provided with a photo-addressable thermally developable element produced as described in the description and including the dye and a compound corresponding to the formula

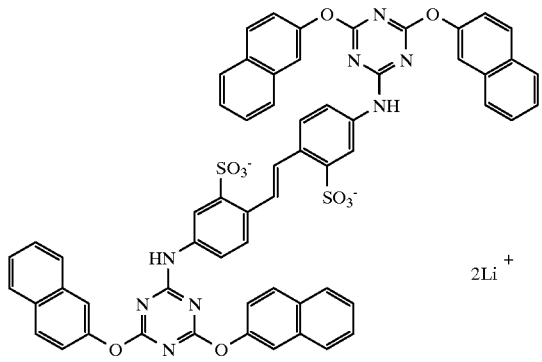

is >90% of an exposure required by a photothermographic recording material B produced as described for the photothermographic recording material A except that the compound is omitted, the exposure of the materials A and B being that required to obtain an optical density in an exposed part thereof 0.5 higher than in an non-exposed part thereof when exposed to infra-red light to which it is sensitive and heating with a heat source at 105° C. for 15 s with the polyester support thereof in contact with the heat source; and a production process therefor.

5 Claims, No Drawings

PHOTOTHERMOGRAPHIC RECORDING MATERIAL COMPRISING IR-SENSITIZING DYES

The application claim the benefit of U.S. Provisional Application No. 60/027,501, filed Sep. 27, 1996.

DESCRIPTION

1. Field of the Invention

The present invention relates to a photothermographic recording material comprising photosensitive silver halide spectrally sensitized with specific dyes and a recording process therefor.

2. Background of the Invention

Thermal imaging or thermography is a recording process wherein images are generated by the use of imagewise modulated thermal energy.

In thermography three approaches are known:

1. Direct thermal formation of a visible image pattern by imagewise heating of a recording material containing matter that by chemical or physical process changes colour or optical density.
2. Imagewise transfer of an ingredient necessary for the chemical or physical process bringing about changes in colour or optical density to a receptor element.
3. Thermal dye transfer printing wherein a visible image pattern is formed by transfer of a coloured species from an imagewise heated donor element onto a receptor element.

Thermographic materials of type 1 become photothermographic when a photosensitive agent is present which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

The most widely used radiation-sensitive salt in such materials is silver halide, which must be present in catalytic association with the organic silver salt so that the species formed on exposure can catalyze the thermal image forming process. Silver halide requires spectral sensitization with dyes to extend its sensitivity range into the infra-red region of actinic radiation.

Different classes of benzoxazole, benzothiazole and benzoselenazole cyanine spectral sensitizers have been disclosed for use in infrared-sensitive photothermographic materials on the basis of organic silver salts/silver halide/reducing agent-systems: U.S. Pat. No. 4,835,096 discloses a photothermographic element characterised in that it contains as a sensitizer a dye of the general formula:

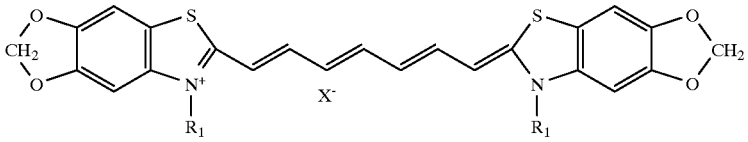

wherein $R_1$ represents a lower alkyl group of from 1 to 5 carbon atoms and $X^-$ represents an anion: JN03-163440A discloses a heat developing photosensitive element comprising at least one sensitizing dye of formula (I):

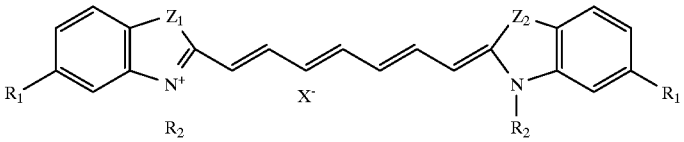

wherein $Z_1$ and $Z_2$ are each S, O or Se; $R_1$=H, alkyl, alkoxy; $R_2$=carboxyalkyl or —$(CH_2)_n$COOH; n=1 to 4; and X=Cl, Br or I; U.S. Pat. No. 5,441,866 discloses a heat-developable photothermographic element comprising a preferably hydrophobic binder. supersensitizer and a spectrally sensitizing amount of an infrared absorbing dye having the central nucleus:

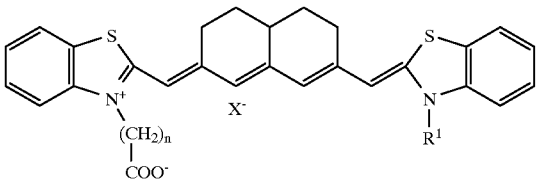

wherein $R^1$ represents a $(CH_2)_n$—COO group of from 1–20 carbon atoms, or an alkyl group of from 1 to 20 carbon atoms; and n is an integer from 1 to 20; and EP-A 616 014 discloses a heptamethine cyanine dye characterised in that both nitrogen atoms of the cyanine chromophore bear a 5 carboxyalkyl substituent comprising an alkyl chain of at least five carbon atoms, which may be used in conjunction with supersensitizers such as 2-mercaptobenzimidazoles, metal chelating agents and pyridine, pyrimidine and triazine derivatives. The detailed descriptions and invention examples of all this patents are confined to photoaddressable thermally developable elements coated from non-aqueous media.

There are no indications in these patents regarding the applicability of the particular inventions described therein to photothermographic recording materials comprising a photo-addressable thermally developable elements coated from an aqueous medium.

This reflects the standard teaching over such photothermographic materials based on a substantially light-insensitive organic silver salt, photosensitive silver halide in intimate catalytic association with the organic silver salt and a reducing agent for the organic silver salt, which is that such materials are coated from non-aqueous media. It is however, for economic, safety and ecological reasons, desirable to coat such materials from aqueous media.

The production methods in accordance with the standard teaching are very inefficient, requiring investment in explosion-prevention production infrastructure and infrastructure for solvent recovery and the expenditure of energy in several drying processes, and are ecologically unsound. It is, therefore, desirable to develop an alternative material technology in which coating from solvent media is replaced by coating from aqueous media.

However, the inventors' investigations into the spectral sensitization of photothermographic materials based on organic silver salts/silver halide/reducing agent-systems coated from aqueous media have shown that materials technology developed for such materials coated from non-aqueous media cannot be readily extrapolated to such materials coated from aqueous media.

Furthermore, all the IR-spectral sensitizers disclosed for the spectral sensitization of such photothermographic materials require the presence of a supersensitizer in concentrations of between 3 and 50 moles/mole spectral sensitizer to exhibit acceptable spectral sensitization. The presence of an extra ingredient in such large quantities is disadvantageous both from an economic standpoint and from the danger of interference with functional ingredients.

OBJECTS OF THE INVENTION

It is a first object of the invention to provide a photothermographic recording material comprising a photo-addressable thermally developable element with a high infra-red sensitivity and excellent image-forming properties, which can be coated from aqueous media.

It is a second object of the invention to provide an infra-red spectral sensitizer which can efficiently sensitize a photo-addressable thermally developable element in the absence of a supersensitizer.

Further objects and advantages of the invention will become apparent from the description hereinafter.

SUMMARY OF THE INVENTION

According to the present invention, a photothermographic recording material is provided comprising a support and a photo-addressable thermally developable element containing a substantially light-insensitive organic silver salt, a reducing agent therefor in thermal working relationship therewith, photosensitive silver halide spectrally sensitized to wavelengths >700 nm with a dye and in catalytic association with said substantially light-insensitive organic silver salt and a water-soluble binder, a water-dispersible binder or a mixture of a water-soluble and a water-dispersible binder, wherein said photothermographic recording material has an infra-red sensitivity of less than 80 J/m$^2$ and said dye satisfies the following test: an exposure required by a photothermographic recording material A, consisting of a polyester 100 $\mu$m thick support provided with a photo-addressable thermally developable element produced as follows:

i) a coating dispersion is produced by adding with stirring the following ingredients to a stabilized aqueous dispersion of finely divided silver behenate at a pH of 6.5:

3-(triphenyl-phosphonium)propionic acid bromide in a quantity corresponding to 8 mol % with respect to the silver behenate in the dispersion as an aqueous solution with a pH of 4 followed by at least 10 minutes stirring;

the dilithium salt of 2,2'-disulfo-4,4'-bis[2-{4,6-bis(2-oxy-naphtho)}-triazino]-aminostilbene corresponding to the formula

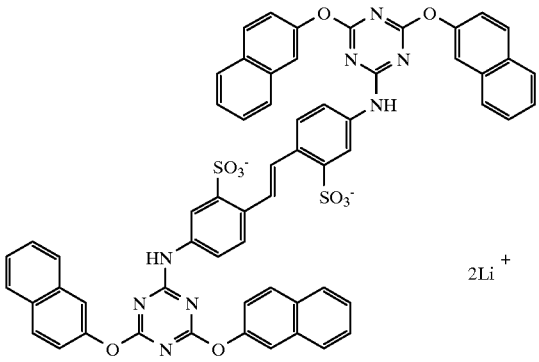

if appropriate, as a solution in methanol;

said dye as a solution or dispersion in water and/or methanol followed by at least 15 minutes stirring;

a film-forming non-proteinaceous binder in a quantity equal in weight to the silver behenate in the dispersion as an aqueous solution or dispersion with a pH of 4; and 3-(3',4'-dihydroxyphenyl)propionic acid in a quantity of 40 mol % with respect to the silver behenate in the dispersion as an aqueous solution;

ii) the dispersion is then coated onto a subbed 100 $\mu$m thick polyethylene terephthalate support and dried to yield a coating weight of silver behenate of approximately 4.5 g/m$^2$; is >90% of an exposure required by a photothermographic recording material B produced as described for said photothermographic recording material A except that said dilithium salt of 2,2'-disulfo-4,4'-bis[2-{4,6-bis(2-oxy-naphtho)}-triazino]-aminostilbene is omitted, said exposure of said materials A and B being that required to obtain an optical density in an exposed part thereof 0.5 higher than in an non-exposed part thereof when exposed to infra-red light to which it is sensitive and heating with a heat source at 105° C. for 15s with said polyester support thereof in contact with said heat source.

According to the present invention, a process is also provided for producing a photothermographic recording material, as referred to above, comprising the steps of: (i) producing an aqueous dispersion or aqueous dispersions containing the substantially light-insensitive organic silver salt, the photosensitive silver halide spectrally sensitized to infra-red light with the dye, the reducing agent and the water-soluble binder, water-dispersible binder or mixture of a water-soluble and a water-dispersible binder; (ii) coating the aqueous dispersion or aqueous dispersions onto a support.

The term infra-red light for the purposes of the present invention means light with a wavelength in the range from 700 nm to 1000 $\mu$m.

Preferred embodiments of the invention are disclosed in the dependent claims.

DETAILED DESCRIPTION OF THE INVENTION

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

IR-spectrally sensitizing dyes

According to the present invention the photo-addressable thermally developable element contains a dye satisfying the above-mentioned test.

The dilithium salt of 2,2'-disulfo-4,4'-bis[2-{4,6-bis(2-oxy-naphtho)}-triazino]-aminostilbene was chosen as the supersensitizer for the above-mentioned test because it had been found to be an efficient supersensitizer for photothermographic recording materials comprising a photo-addressable thermally developable element coated from aqueous media as is disclosed by the inventors in a copending European Patent Application and can be seen from the comparative examples.

In a preferred embodiment of the present invention the photothermographic recording material has an infra-red sensitivity of less than 20 J/m$^2$ and in a particularly preferred embodiment of the present invention the photothermographic recording material has an infra-red sensitivity of less than 8 J/m$^2$.

In a preferred embodiment of the photothermographic recording material of the present invention, the dye is a merocyanine dye and in a further preferred embodiment of the photothermographic recording material of the present invention, the dye is a heptamethine cyanine dye.

In a particularly preferred embodiment of the photothermographic recording material of the present invention, the dye corresponds to the general formula (I):

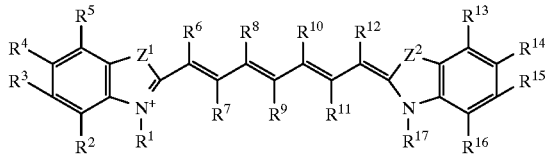

with an anion if necessary for charge compensation, wherein $Z^1$ and $Z^2$ independently represent S, O or Se; $R^1$ and $R^{17}$ are independently each an alkyl which may be substituted with at least one fluorine, chlorine, bromine, iodine or an aryloxy-, alkoxy-, —(C=O)—R, —(S=O)— R' or —($SO_2$)—R' group, where R is an alkoxy, aryloxy or amino group and R' is a hydroxy, mercapto, alkoxy, aryloxy or amino group; $R^2$, $R^3$, $R^4$, $R^5$, $R^{13}$, $R^{14}$ , $R^{15}$ and $R^{16}$ are independently each hydrogen, chlorine, bromine, fluorine or a keto-, sulfo-, carboxy-, ester-, sulfonamide-, amide-, dialkylamino-, nitro-, cyano-, alkyl-, alkenyl-, heteroaromatic, aryl-, alkoxy- or aryloxy-group; or each of $R^2$ together with $R^3$, $R^3$ together with $R^4$, $R^4$ together with $R^5$, $R^{13}$ together with $R^{14}$, $R^{14}$ together with $R^{15}$ and $R^{15}$ together with $R^{16}$ may independently constitute the atoms necessary to complete a benzene ring; $R^6$, $R^7$, $R^8$, $R^9$, $R^{10}$, $R^{11}$ and $R^{12}$ independently represent hydrogen, an alkyl group, a substituted alkyl group, an alkoxy group, an aryloxy group, a thioalkyl group, a thioaryl group, chlorine, fluorine, bromine, iodine, a disubstituted amino group, wherein the substituents may constitute the atoms necessary to complete a 5-ring atom or 6-ring atom heterocyclic ring, or each of $R^6$ together with $R^8$, $R^8$ together with $R^{10}$, $R^{10}$ together with $R^{12}$, $R^7$ together with $R^9$ and $R^9$ together with $R^{11}$ may independently constitute the atoms necessary to complete a 5-atom or 6-atom carbocyclic or heterocyclic ring; and each of $R^1$ together with $R^6$ and $R^{12}$ together with $R^{17}$ may independently constitute the atoms necessary to complete a 5-atom or 6-atom heterocyclic ring.

In the case that the R group in the —(C=O)—R group or R' group in the —(S=O)—R' and —($SO_2$)—R' groups represents a substituted amino group, this includes all possible substitutions of the amino group, including thereby, —NH—(C=O)—R", —NH—($SO_2$)—R", —NH—(S=O)—R", —$N^-$—CN, —$N^-$—(C=O)—R", —$N^-$—($SO_2$)—R", —$N^-$—(S=O)—R" and —$N^-$—CN groups where R" is an alkyl or aryl group.

Substituents and carbocyclic and herocyclic rings closed by said substituents in the dye of general formula (I) may also be substituted, where no specific substituents are mentioned.

In an especially preferred embodiment of the present invention the dye corresponds to the formula

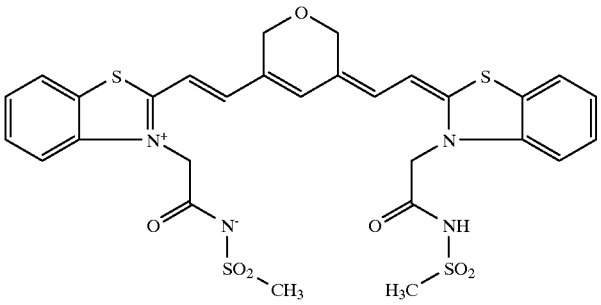

In a further especially preferred embodiment of the present invention the dye corresponds to the formula

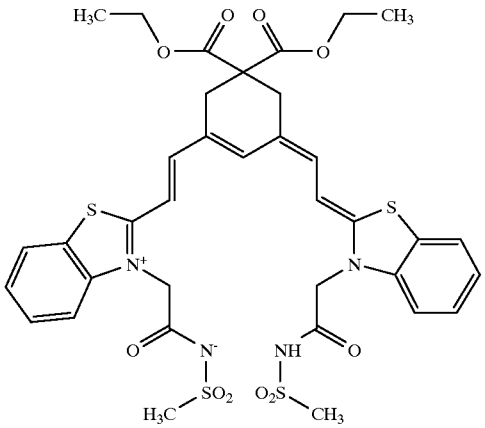

In a yet further especially preferred embodiment of the present invention the dye corresponds to the formula

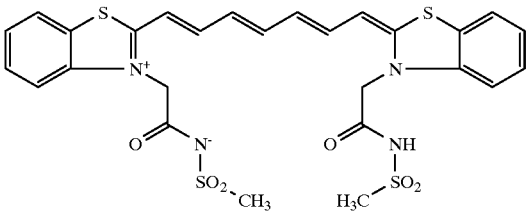

In a yet further especially preferred embodiment of the present invention the dye corresponds to the formula

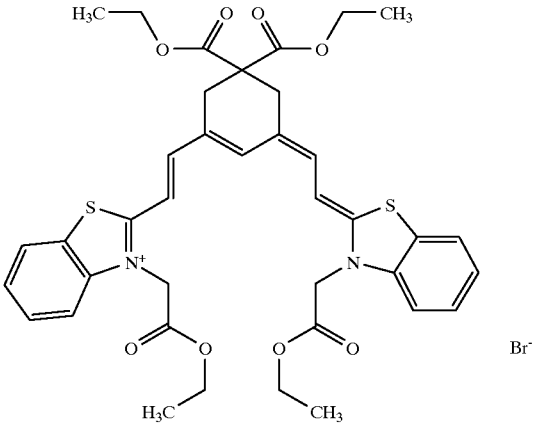

Suitable IR-sensitizing dyes used according to the present invention are:

SENSI 01:

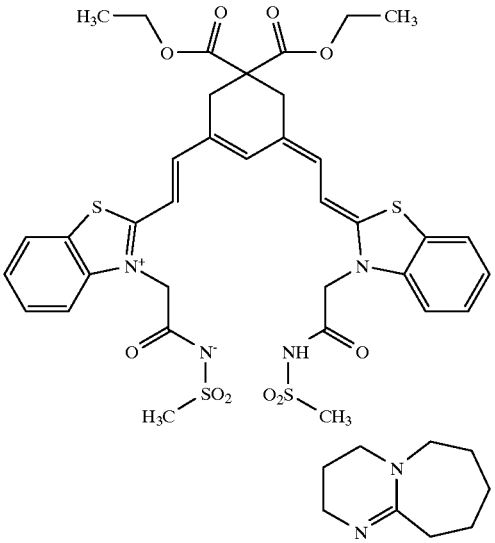

SENSI 02:

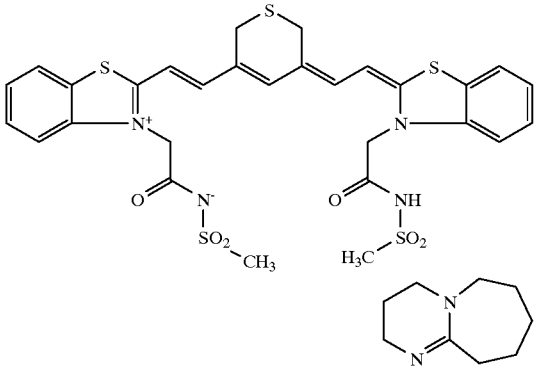

SENSI 03:

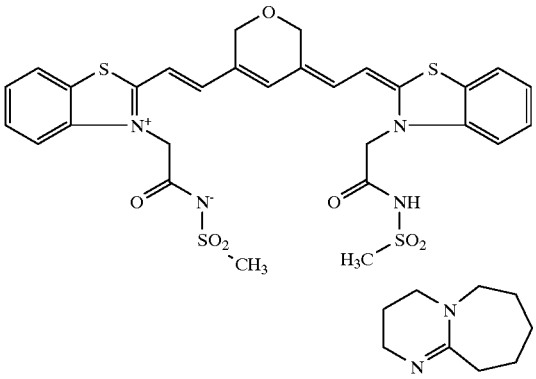

SENSI 04:

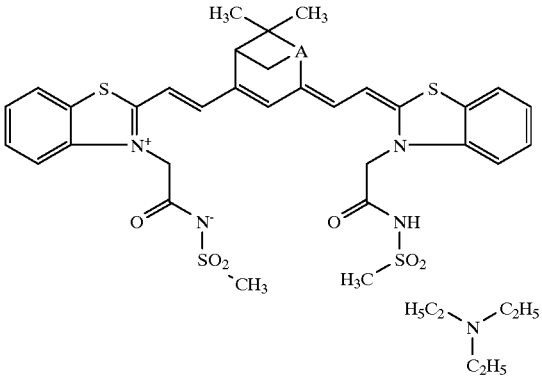

SENSI 05:

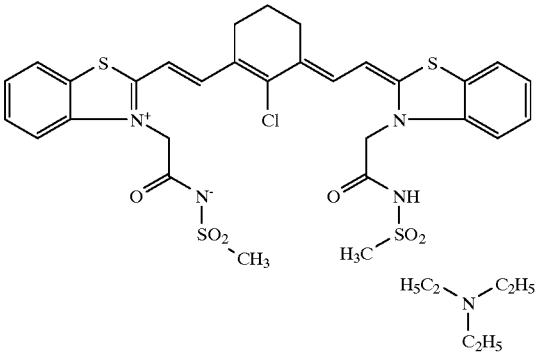

SENSI 06:

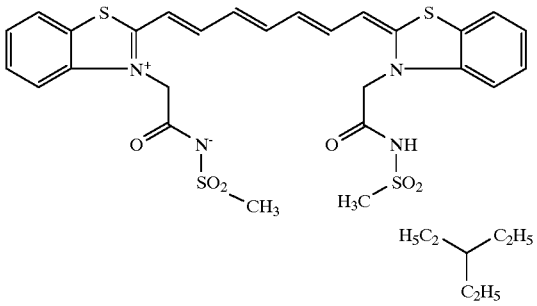

SENSI 07:

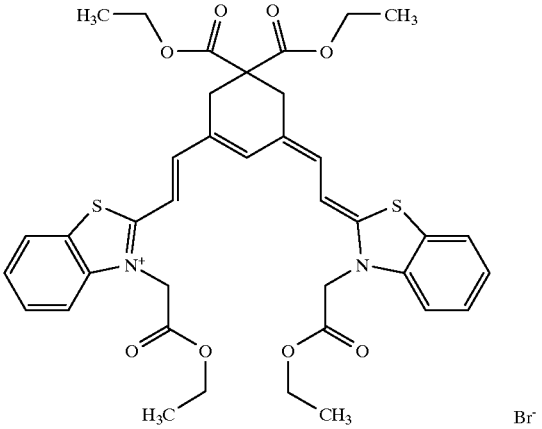

SENSI 01 was synthesized as described in INVENTION EXAMPLE 1. Similar synthetic techniques to those described in INVENTION EXAMPLE 1 and those described in F. M. Hamer, "The Cyanine Dyes and Related Compounds", Interscience Publishers, New York (1964) can be used to synthesize other IR-sensitizing dyes used according to the present invention.

The sensitivity of the photothermographic recording materials comprising IR-sensitizing dyes used according to the present invention will depend upon the choice of IR-sensitizing dye, the concentration thereof, the way in which the IR-sensitizing dye is incorporated and the exact composition of the photothermographic recording material.

Photo-addressable thermally developable element

The photo-addressable thermally developable element, used according to the present invention, comprises a substantially light-insensitive organic silver salt, photosensitive silver halide in catalytic association therewith and an organic reducing agent in thermal working relationship with the substantially light-insensitive organic silver salt and a water soluble or water-dispersible binder. The element may comprise a layer system with the silver halide in catalytic association with the substantially light-insensitive organic silver salt, spectral sensitizer optionally together with a supersensitizer in sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive organic silver salt.

Substantially light-insensitive organic silver salts

Preferred substantially light-insensitive organic silver salts used according to the present invention are silver salts of organic carboxylic acids in particular aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Photosensitive silver halide

The photosensitive silver halide used in the present invention may be employed in a range of from 0.1 to 35 mol percent of substantially light-insensitive organic silver salt, with the range of 0.5 to 20 mol percent being preferred and the range of 1 to 12 mol percent being particularly preferred.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

According to a preferred embodiment used according to the present invention, particles of the photosensitive silver halide are non-aggregating in the photo-addressable thermally developable element and are uniformly distributed over and between particles of the substantially light-insensitive organic silver salt, at least 80% by number of the particles having a diameter, determined by transmission electron microscopy, of ≦40 nm.

Emulsion of organic silver salt and photosensitive silver halide

According to a process, used according to the present invention, the suspension of particles of a substantially light-insensitive organic silver salt may be produced by simultaneous metered addition of an aqueous solution or suspension of an organic carboxylic acid, or its salt, and an aqueous solution of a silver salt to an aqueous liquid and the metered addition of the aqueous solution or suspension of the organic carboxylic acid or its salt: and/or the aqueous solution of the silver salt is regulated by the concentration of silver ions or the concentration of anions of the silver salt in the aqueous liquid.

The silver halide may be added to the photo-addressable thermally developable element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

According to another preferred embodiment used according to the present invention, a production process for the photothermographic recording material is provided further comprising the step of forming particles of the photosensitive silver halide by reacting an aqueous emulsion of particles of the substantially light-insensitive organic silver salt with at least one onium salt with halide or polyhalide anion(s).

The aqueous emulsion of the organic silver salt optionally including photosensitive silver halide can, according to the present invention, also be produced from particles of the organic silver salt optionally containing photosensitive silver halide by dispersing the particles in water in the presence of non-ionic or anionic surfactants or a mixture of non-ionic and anionic surfactants using any dispersion technique known to one skilled in the art such as ball milling, dispersion in a impingement mill (rotor-stator mixer), dispersion in a microfluidizer etc. A combination of dispersion techniques may also be used, for example using a first technique to produce a predispersion and a second technique to produce a fine dispersion.

Onium halides and polyhalides

According to the present invention photosensitive silver halide particles produced by reacting an aqueous dispersion of particles of the substantially light-insensitive organic silver salt with at least one onium salt with halide or polyhalide anions may be present. Onium cations, used according to the present invention, may be polymeric or non-polymeric. Preferred non-polymeric onium salts for partial conversion of particles of substantially light-insensitive organic silver salt into photosensitive silver halides used according to the present invention are:

PC01 = 3-(triphenyl-phosphonium)propionic acid bromide perbromide

PC02 = 3-(triphenyl-phosphonium)propionic acid bromide

PC03 = 3-(triphenyl-phosphonium)propionic acid iodide

The onium salts are present in quantities of between 0.1 and 35 mol % with respect to the quantity of substantially light-insensitive organic silver salt of organic, with quantities between 0.5 and 20 mol % being preferred and with quantities between 1 and 12 mol % being particularly preferred.

Organic reducing agent for photo-addressable thermally developable elements coated from aqueous media Suitable organic reducing agents for the reduction of the substantially light-insensitive organic heavy metal salts in photo-addressable thermally developable coated from aqueous media are organic compounds containing at least one active hydrogen atom linked to O, N or C. Particularly suitable organic reducing agents for the reduction of the substantially light-insensitive organic silver salt in such photo-addressable thermally developable elements are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substituent is an amino-group.

Particularly preferred reducing agents are substituted catechols or substitued hydroquinones with 3-(3',4'-dihydroxyphenyl)-propionic acid, 3', 4'-dihydroxybutyrophenone, methyl gallate, ethyl gallate and 1,5-dihydroxy-naphthalene being especially preferred.

Reducing agent incorporation

During the thermal development process the reducing agent must be present in such a way that it is able to diffuse to the substantially light-insensitive organic silver salt particles so that reduction of the organic silver salt can take place.

Auxiliary reducing agents

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Water-dispersible and water-soluble binders

According to the present invention the photo-addressable thermally developable element comprises a binder comprising a water-soluble binder, a water-dispersible binder or a mixture of a water soluble binder and a water-dispersible binder. An important prerequisite in the choice of binders and binder-mixtures is their ability to form a continuous layer with the other ingredients present.

The water-dispersible binder can be any water-insoluble polymer e.g. water-insoluble cellulose derivatives, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed under the trade name BUTVAR B79 of Monsanto USA and provides a good adhesion to paper and properly subbed polyester supports. It should be noted that there is no clear cut transition between a polymer dispersion and a polymer solution in the case of very small polymer particles resulting in the smallest particles of the polymer being dissolved and those slightly larger being in dispersion.

Suitable water-soluble polymers, used according to the present invention, are: polyvinyl alcohol, polyacrylamide, polyacrylic acid, polymethacrylic acid, polyethyleneglycol, proteins, such as gelatin and modified gelatins such as phthaloyl gelatin, polysaccharides, such as starch, gum arabic and dextran and water-soluble cellulose derivatives.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Weight ratio of binder to organic silver salt

The binder to organic silver salt weight ratio is preferably in the range of 0.2 to 6, and the thickness of the photo-addressable thermally developable element is preferably in the range of 1 to 50 μm,

Thermal solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C.

Toning agent

In order to obtain a neutral black image tone in the higher densities and neutral grey in the lower densities the photo-addressable thermally developable element contains preferably in admixture with the organic silver salts and reducing agents a so-called toning agent known from thermography or photothermography.

Suitable toning agents are succinimide and the phthalimides and phthalazinones within the scope of the general formulae described in U.S. Pat. No. 4,082,901. Further reference is made to the toning agents described in U.S. Pat. Nos. 3,074,809, 3,446,648 and 3.844,797. Other particularly useful toning agents are the heterocyclic toner compounds of the benzoxazine dione or naphthoxazine dione as described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Stabilizers and antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716: the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989): in Research Disclosure 17029 published in June 1978; and in the references cited in all these documents.

Surfactants

Non-ionic, cationic or anionic surfactants may be used, according to the present invention, to produce dispersions of particles of the substantially light-insensitive organic silver salt in aqueous media and to disperse water-dispersible binders, such as polymer latexes, in aqueous media. In a preferred embodiment of the present invention the surfactant is a sulfonate e.g. alkyl, aryl, alkaryl or aralkyl sulfonate, with alkyl and alkaryl sulfonates being particularly preferred e.g.:

MERSOLAT™ H, a sodium salt of an alkyl sulfonate from BAYER

ULTRAVON™ W, a sodium salt of an aryl sulfonate from CIBA-GEIGY

Other additives

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG - GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Antihalation dyes

According to a preferred embodiment of the present invention, the photothermographic recording material further comprises an antihalation or acutance dye which absorbs light which has passed through the photosensitive layer, thereby preventing its reflection. Such dyes may be incorporated into the photo-addressable thermally developable element or in any other layer comprising the photothermographic recording material of the present invention. The antihalation dye may also be bleached either thermally during the thermal development process or photo-bleached after removable after the thermal development process and it may be contained in a layer which can be removed subsequent to the exposure process. Suitable antihalation dyes for use with infra-red light are described in the EP-A's 377 961 and 652 473, the EP-B's 101 646 and 102 781 and the U.S. Pat. Nos. 4,581,325 and 5,380,635.

Support

The support for the photothermographic recording material used according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl or static.

Protective layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

The protective layer preferably comprises a binder, which may be solvent soluble (hydrophobic), solvent dispersible, water soluble (hydrophilic) or water dispersible. Among the hydrophobic binders cellulose acetate butyrate, polymethylmethacrylate and polycarbonates, for example as described in EP-A 614 769, are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer of the photothermographic recording material, used according to the present invention, may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer used according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating

The coating of any layer of the photothermographic recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Photothermographic recording process

Photothermographic materials, used according to the present invention, may be exposed with infrared radiation of wavelength >700 nm with the image either being obtained by pixel-wise exposure with a finely focussed light source, such as an IR wavelength laser or an IR-laser diode, e.g. emitting at 780 nm, 830 nm or 850 nm; or by direct exposure to the object itself or an image therefrom with appropriate illumination with IR light.

For the thermal development of image-wise exposed photothermographic recording materials, used according to the present invention, any sort of heat source can be used that enables the recording materials to be uniformly heated to the development temperature in a time acceptable for the application concerned e.g. contact heating, radiative heating, microwave heating etc.

According to the present invention a photothermographic recording process is also provided comprising the steps of: (i) image-wise exposing a photothermographic recording material, as referred to above, with actinic radiation to which the photothermographic recording material is sensitive; and (ii) thermally developing the image-wise exposed photothermographic recording material.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the appending claims.

The following ingredients in addition to those mentioned above were used in the photothermographic recording materials of the invention examples and comparative examples:

a) photo-addressable thermally developable element ingredients for coating of element from aqueous media:

BINDER 01: copolymer consisting of 45% by weight of methylmethacrylate, 45% by weight of butadiene and 10% by weight of itaconic acid.

SENSI C01:

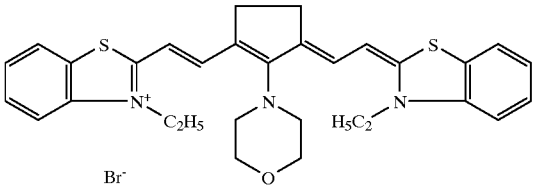

SENSI C02:

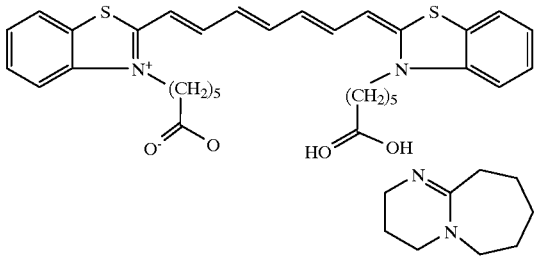

SENSI C03:

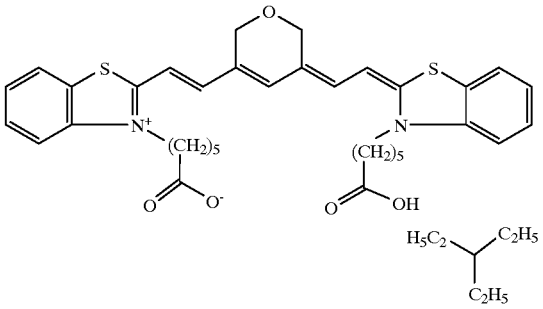

The following examples and comparative examples illustrate the present invention. The percentages and ratios used in the examples are by weight unless otherwise indicated.

INVENTION EXAMPLE 1

Synthesis of SENSI 01:

The synthesis of SENSI 01 involves the coupling of two intermediates, A and B, which are themselves synthesized from a succession of intermediates in a synthesis ladder.

Synthesis of intermediate A:

The first step in the synthesis of intermediate A was the synthesis of D. D was prepared according to the following reaction scheme:

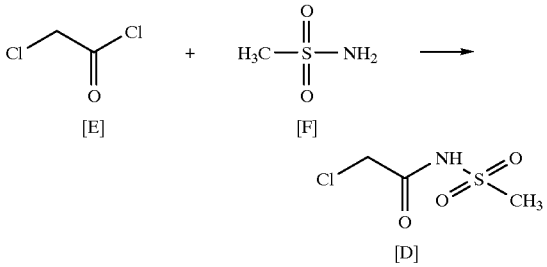

10 L of butylacetate, 2425 g of F en 3038 g of E were added to a flask and the mixture heated to the reflux temperature and then heated for a further 8 hours at the reflux temperature. Upon subsequent cooling to room temperature, the product precipitated out. It was then filtered off and washed with butyl acetate to produce a yield of 74% of intermediate D.

Intermediate A was then synthesized according to the following reaction scheme:

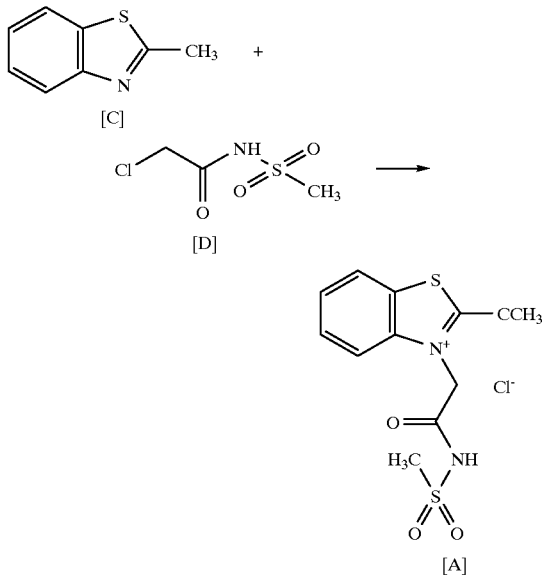

294 g of intermediate D, 343 g of intermediate C and 600 mL of sulfolan was added to a flask and heating with stirring on an oil bath for 24 hours at 125° C. The reaction mixture was then cooled to 60° C. and 1200 mL of acetone added. The resulting suspension was then stirred for 1 hour at room temperature after which it was filtered and thoroughly washed with acetone to produce a 51% yield of intermediate A.

Synthesis of intermediate B:

The first step in the synthesis of intermediate B, was the preparation of intermediate H according to the following synthesis scheme:

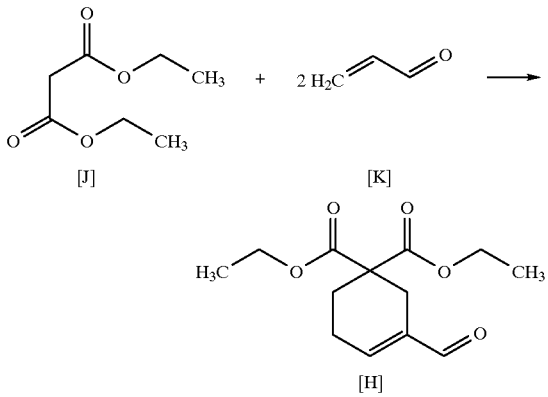

2 L of ethanol, 5.5 g of sodium ethoxide and 759 mL diethyl malonate were added to a flask and the mixture cooled to −30° C. and the atmosphere above the mixture changed to nitrogen. 758 mL of acrolein dissolved in 750 mL of ethanol were then added over a period of 60 hours while maintaining the temperature of the reaction mixture between 0 and 5° C.

Upon completion of the acrolein addition the temperature was allowed to rise to room temperature and 8 g of sodium ethoxide dissolved in 180 mL of ethanol was added. After allowing to stand overnight, 19 mL of acetic acid was added and the reaction mixture evaporated under reduced pressure. The liquid residue was then distilled under reduced temperature to produce a 26% yield of intermediate H.

Intermediate H was then used to prepare intermediate G according to the following synthesis scheme:

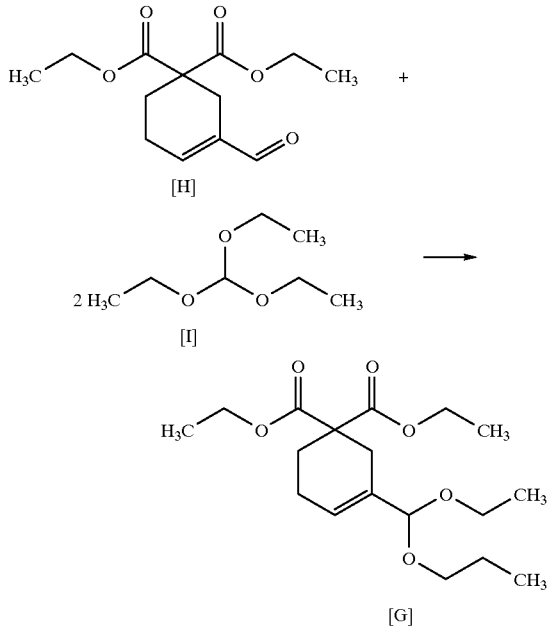

162 g of intermediate H, 162 mL of ethanol and 0.16 g of p-toluenesulfonic acid monohydrate were added to a flask and thoroughly mixed at room temperature. 206 mL of intermediate I were then added with stirring and the stirred reaction mixture then heated to 30 to 40° C. until the reaction was completed. 0.33 mL of a 33% solution of odium methoxide was then added and the mixture stirred at 30 to 40° C. for a further 15 minutes. Finally the reaction mixture was vacuum distilled to produce a 99% yield of intermediate G.

Intermediate G was then used to prepare intermediate B according to the following reaction scheme:

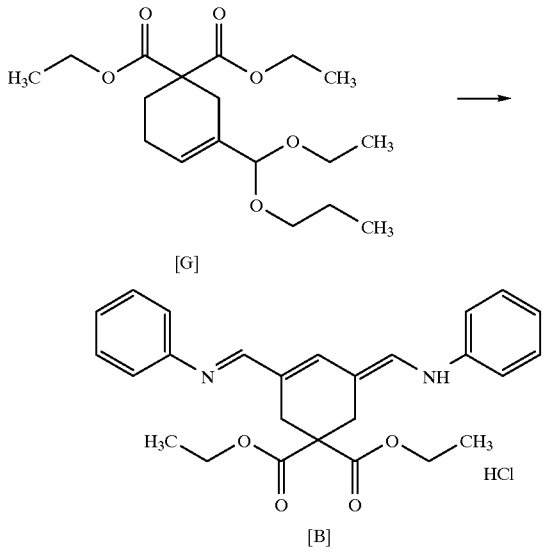

73 mL of dimethylformamide in a flask was cooled to 0° C. 59 mL of phosphoryl chloride were then added with stirring and the mixture stirred for a further hour at room temperature. 98 g of intermediate G were then added with stirring and the mixture stirred for a further 90 minutes at room temperature. 720 mL of ethanol and 33 mL of deionized water were then added and the mixture stirred for a further 30 minutes at room temperature. 273 mL of aniline were then added with stirring and the mixture stirred for a further 30 minutes at room temperature. Finally 3000 mL of a 6N solution of hydrochloric acid was added and the mixture stirred for a further 15 minutes at room temperature. The resulting precipitate was filtered off and washed with a warm mixture of methanol and ethyl acetate to produce an 86% yield of intermediate B.

Synthesis of SENSI 01:

SENSI 01 was prepared according to the following reaction scheme:

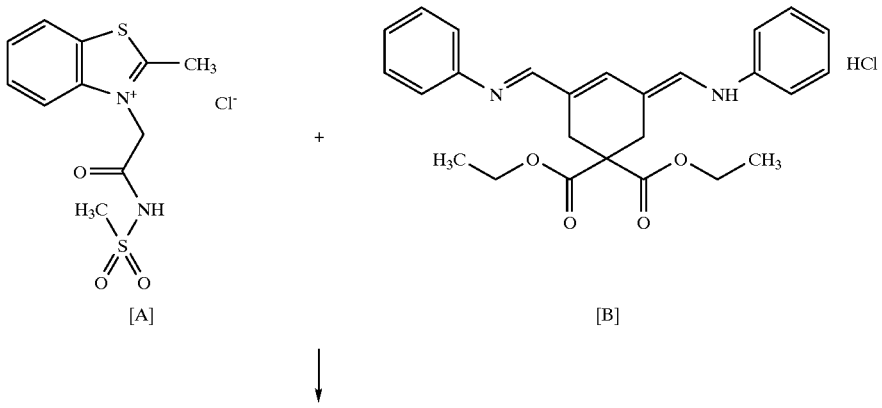

-continued

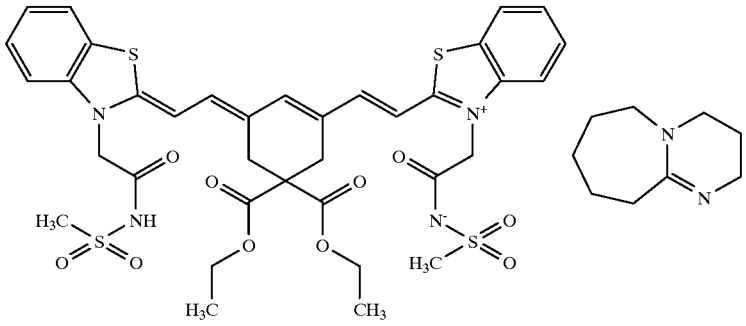

28 g of intermediate B, 180 mL of N,N-dimethylacetamide, 11 ml of acetic acid anhydride and 37 mL of 1–8 diazabicyclo[5,4,0]undec-7ene were added to a flask and mixed at room temperature to produce an orange solution. 39 g of intermediate A were then added to the reaction mixture and then stirred for 2.5 hours at room temperature. An extra 9 mL of 1–8 diazabicyclo[5,4,0]undec-7ene were then added and the mixture stirred for a further hour at room temperature. Finally 360 mL of acetone were added to precipitate the product and filtration, washing and drying produced a 62% yield of SENSI 01.

INVENTION EXAMPLES 2 to 35 and COMPARATIVE EXAMPLES 1 to 6

Silver behenate dispersion

Silver behenate was prepared by dissolving 34 g (0.1 moles) of behenic acid in 340 mL of 2-propanol at 65° C., converting the behenic acid to sodium behenate by adding 400 mL of 0.25M aqueous sodium hydroxide to the stirred behenic acid solution and finally adding 250 mL of 0.4M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersolat™ H to produce, after rapid mixing using a high speed impingement mill (rotor-stator mixer) to obtain a paste and homogenization with a microfluidizer, a finely divided and stable dispersion containing 20% by weight of silver behenate, 2.1% by weight of Ultravon™ W and 0.203% by weight of Mersolat™ H. The pH of the resulting dispersion was adjusted to about 6.5.

The following ingredients were then added with stirring to 3.0 g of the silver behenate dispersion: 2 g of a 2.22% by weight aqueous solution of 3-(triphenyl-phosphonium) propionic acid bromide (PC02), corresponding to a concentration of 8 mol% of PC02 with respect to silver behenate, at a pH of 4 to accomplish in situ conversion of part of the silver behenate to silver bromide. After 10 minutes further stirring, the supersensitizer was added with stirring as a solution in water and/or methanol, as specified in table 1, immediately followed by the IR-spectral sensitizer as a solution or dispersion in water and/or methanol as specified in table 1. After stirring for a further 15 minutes 2 g of a 30% by weight concentration of BINDER 01 at a pH of 4 was added with stirring owed by 2 g of a 4.5% by weight aqueous solution of 3-(3', 4'-dihyroxyphenyl)propionic acid.

TABLE 1

| | IR-sensitizer | | | | supersensitizer | |
|---|---|---|---|---|---|---|
| | code | Weight of solution [g] | Conc. of solution [% by wt] | mmol /mol silver behenate* | Weight of solution [g] | Conc. of solution [% by wt] |
| Invention example number | | | | | | |
| 2 | SENSI 01 | 0.200 | 0.1 (MeOH) | 0.15 | — | — |
| 3 | SENSI 01 | 0.200 | 0.1 (MeOH) | 0.15 | 1.5 | 0.25 (MeOH) |
| 4 | SENSI 01 | 0.240 | 0.1 (MeOH) | 0.19 | | — |
| 5 | SENSI 01 | 0.240 | 0.1 (MeOH) | 0.19 | 2.5 | 0.25 (MeOH) |
| 6 | SENSI 02 | 0.160 | 0.1 (MeOH) | 0.14 | — | — |
| 7 | SENSI 02 | 0.160 | 0.1 (MeOH) | 0.14 | 0.6 | 0.25 (MeOH) |
| 8 | SENSI 03 | 0.046 | 0.2 (MeOH) | 0.08 | — | — |
| 9 | SENSI 03 | 0.046 | 0.2 (MeOH) | 0.08 | 0.6 | 0.25 (MeOH) |
| 10 | SENSI 03 | 0.046 | 0.2 (MeOH) | 0.08 | 1.2 | 0.25 (MeOH) |
| 11 | SENSI 03 | 0.110 | 0.2 (MeOH) | 0.20 | — | — |
| 12 | SENSI 03 | 0.110 | 0.2 (MeOH) | 0.20 | 0.6 | 0.25 (MeOH) |
| 13 | SENSI 03 | 0.110 | 0.2 (MeOH) | 0.20 | 1.2 | 0.25 (MeOH) |
| 14 | SENSI 03 | 0.170 | 0.2 (MeOH) | 0.31 | — | — |
| 15 | SENSI 03 | 0.170 | 0.2 (MeOH) | 0.31 | 0.6 | 0.25 (MeOH) |
| 16 | SENSI 03 | 0.170 | 0.2 (MeOH) | 0.31 | 1.2 | 0.25 (MeOH) |

TABLE 1-continued

| | IR-sensitizer | | | | supersensitizer | |
|---|---|---|---|---|---|---|
| | code | Weight of solution [g] | Conc. of solution [% by wt] | mmol /mol silver behenate* | Weight of solution [g] | Conc. of solution [% by wt] |
| 17 | SENSI 03 | 0.270 | 0.2 (MeOH) | 0.49 | — | — |
| 18 | SENSI 03 | 0.270 | 0.2 (MeOH) | 0.49 | 0.6 | 0.25 (MeOH) |
| 19 | SENSI 03 | 0.270 | 0.2 (MeOH) | 0.49 | 1.2 | 0.25 (MeOH) |
| 20 | SENSI 04 | 0.110 | 0.3 (MeOH) | 0.30 | — | — |
| 21 | SENSI 04 | 0.110 | 0.3 (MeOH) | 0.30 | 1.2 | 0.25 (MeOH) |
| 22 | SENSI 05 | 0.046 | 0.3 (MeOH) | 0.13 | — | — |
| 23 | SENSI 05 | 0.046 | 0.3 (MeOH) | 0.13 | 0.6 | 0.25 (MeOH) |
| 24 | SENSI 05 | 0.046 | 0.3 (MeOH) | 0.13 | 1.2 | 0.25 (MeOH) |
| 25 | SENSI 06 | 0.046 | 0.3 ($H_2O$) | 0.14 | — | — |
| 26 | SENSI 06 | 0.046 | 0.3 ($H_2O$) | 0.14 | 0.6 | 0.25 (MeOH) |
| 27 | SENSI 06 | 0.046 | 0.3 ($H_2O$) | 0.14 | 1.2 | 0.25 (MeOH) |
| 28 | SENSI 07 | 0.051 | 0.3 (MeOH) | 0.14 | — | — |
| 29 | SENSI 07 | 0.046 | 0.3 (MeOH) | 0.13 | 0.6 | 0.25 (MeOH) |
| 30 | SENSI 07 | 0.046 | 0.3 (MeOH) | 0.13 | 1.2 | 0.25 (MeOH) |
| 31 | SENSI 07 | 0.120 | 0.3 (MeOH) | 0.34 | — | — |
| 32 | SENSI 07 | 0.123 | 0.3 (MeOH) | 0.35 | 1.2 | 0.25 (MeOH) |
| 33 | SENSI 07 | 0.216 | 0.3 (MeOH) | 0.61 | — | — |
| 34 | SENSI 07 | 0.201 | 0.3 (MeOH) | 0.56 | 0.6 | 0.25 (MeOH) |
| 35 | SENSI 07 | 0.224 | 0.3 (MeOH) | 0.63 | 1.2 | 0.25 (MeOH |
| Comparative example number | | | | | | |
| 1 | SENSI C01 | 0.18 | 0.3 (MeOH) | 0.66 | — | — |
| 2 | SENSI C01 | 0.18 | 0.3 (MeOH) | 0.66 | 1.2 | 0.25 (MeOH) |
| 3 | SENSI C02 | 0.070 | 0.2 (MeOH) | 0.14 | — | — |
| 4 | SENSI C02 | 0.070 | 0.2 (MeOH) | 0.14 | 1.2 | 0.25 (MeOH) |
| 5 | SENSI C03 | 0.046 | 0.3 (MeOH) | 0.14 | — | — |
| 6 | SENSI C03 | 0.046 | 0.3 (MeOH) | 0.14 | 1.2 | 0.25 (MeOH) |

*calculated using the quantity of silver behenate present before partial conversion into silver halide

Coating and drying of the photothermographic material

A subbed polyethylene terephthalate support having a thickness of 100 $\mu$m was doctor blade-coated with the silver behenate/silver bromide dispersion at a blade setting of 90 $\mu$m. After drying for several minutes at 40° C. on the coating bed, the emulsion layer was dried for 1 hour in a hot air oven at 40° C.

Image-wise exposure and thermal processing

The photothermographic materials of INVENTION EXAMPLES 2 to 35 and COMPARATIVE EXAMPLES 1 to 6 were exposed to a beam of a 836 nm diode laser type HL 8318G from HITACHI with a nominal power of 12.8 mW focussed to give a spot diameter ($1/e^2$) of 115 $\mu$m, scanned at speed of 5 m/s with a pitch of 63 $\mu$m and an overlap of 30% through a wedge filter with optical density varying between 0 and 3.3 in optical density steps of 0.15. The maximum exposure (filter optical density=0) was about 50 J/$m^2$.

Thermal processing was carried for 15 s with the side of the support not provided with a silver behenate/silver halide emulsion layer with a heated metal block at a temperature of 105° C. The optical densities of the images were measured in transmission with a MacBeth™ TR924 densitometer through a visual filter to produce a sensitometric curve for the photographic recording materials from which the exposure required to obtain an optical density of $D_{min}$+0.5 was determined.

The exposure values for an optical density of $D_{min}$+0.5 obtained upon image-wise exposure and thermal processing of the photothermographic recording materials of INVENTION EXAMPLES 2 to 35 and COMPARATIVE EXAMPLES 1 to 6 together with the IR-sensitizer, supersensitizer, molar ratio of super-sensitizer to IR-sensitizer and the thermal processing conditions used are summarized in table 2.

TABLE 2

| | IR-sensitizer code | moles supersensitizer /mol IR-sensitizer | thermal processing conditions temperature [° C.] | time [s] | Exposure to obtain an O.D. = $D_{min}$ + 0.5 [J/$m^2$] | |
|---|---|---|---|---|---|---|
| Invention example number | | | | | | |
| 2 | SENSI 01 | — | 105 | 15 | 2.8 | |
| 3 | SENSI 01 | 16:1 | 105 | 15 | 3.7 | (132%) |
| 4 | SENSI 01 | — | 105 | 15 | 8.7 | |
| 5 | SENSI 01 | 23:1 | 105 | 15 | >10 | (>115%) |
| 6 | SENSI 02 | — | 105 | 15 | 21 | |
| 7 | SENSI 02 | 7:1 | 105 | 15 | 29 | (138%) |
| 8 | SENSI 03 | — | 105 | 15 | 0.48 | |
| 9 | SENSI 03 | 12:1 | 105 | 15 | 1.2 | (250%) |
| 10 | SENSI 03 | 24:1 | 105 | 15 | 1.9 | (396%) |
| 11 | SENSI 03 | — | 105 | 15 | 3.51 | |
| 12 | SENSI 03 | 5:1 | 105 | 15 | 6.41 | (183%) |
| 13 | SENSI 03 | 10:1 | 105 | 15 | 25 | (712%) |
| 14 | SENSI 03 | — | 105 | 15 | 14.2 | |

TABLE 2-continued

| | IR-sensitizer code | moles super-sensitizer /mol IR-sensitizer | thermal processing conditions temperature [° C.] | time [s] | Exposure to obtain an O.D. = $D_{min}$ + 0.5 [J/m²] | |
|---|---|---|---|---|---|---|
| 15 | SENSI 03 | 3.3:1 | 105 | 15 | 26 | (183%) |
| 16 | SENSI 03 | 6.6:1 | 105 | 15 | 45 | (317%) |
| 17 | SENSI 03 | — | 105 | 15 | 23 | |
| 18 | SENSI 03 | 2.1:1 | 105 | 15 | 45 | (196%) |
| 19 | SENSI 03 | 4.1:1 | 105 | 15 | >50 | (>217%) |
| 20 | SENSI 04 | — | 105 | 15 | 11 | |
| 21 | SENSI 04 | 6.7:1 | 105 | 15 | >>50 | (>455%) |
| 22 | SENSI 05 | — | 105 | 15 | 49 | |
| 23 | SENSI 05 | 8:1 | 105 | 15 | >50 | (>102%) |
| 24 | SENSI 05 | 16:1 | 105 | 15 | >50 | (>102%) |
| 25 | SENSI 06 | — | 105 | 15 | 6.1 | |
| 26 | SENSI 06 | 7.2:1 | 105 | 15 | 9.8 | (161%) |
| 27 | SENSI 06 | 14:1 | 105 | 15 | 10.2 | (167%) |
| 28 | SENSI 07 | — | 105 | 15 | 7 | |
| 29 | SENSI 07 | 7.8:1 | 105 | 15 | 7 | (100%) |
| 30 | SENSI 07 | 15.6:1 | 105 | 15 | 9.7 | (139%) |
| 31 | SENSI 07 | — | 105 | 15 | 10.5 | |
| 32 | SENSI 07 | 5.8:1 | 105 | 15 | 41 | (390%) |
| 33 | SENSI 07 | — | 105 | 15 | 25 | |
| 34 | SENSI 07 | 1.8:1 | 105 | 15 | 29 | (116%) |
| 35 | SENSI 07 | 3.2:1 | 105 | 15 | >>50 | (>>200%) |
| Comparative example number | | | | | | |
| 1 | SENSI C01 | — | 105 | 15 | >>50 | |
| 2 | SENSI C01 | 3:1 | 105 | 15 | 4.7 | |
| 3 | SENSI C02 | — | 105 | 15 | >>50 | |
| 4 | SENSI C02 | 14:1 | 105 | 15 | 5.0 | |
| 5 | SENSI C03 | — | 105 | 15 | >>50 | |
| 6 | SENSI C03 | 14:1 | 105 | 15 | 2.1 | |

It is evident from the results in table 2, that spectral sensitization of photothermographic recording materials with IR-sensitizing dyes, used according to the present invention, results in efficient spectral sensitization in the infra-red region of the spectrum. The presence of the supersensitizer dilithium salt of 2,2'-disulfo-4,4'-bis[2-{4,6-bis(2-oxy-naphtho)}-triazino]-aminostilbene, which exhibits efficient supersensitiization of the photothermographic recording materials of COMPARATIVE EXAMPLES 2. 4 and 6 with the IR-sensitizing dyes SENSI C01, SENSI C02 and SENSI C03, in the case of the IR-sensitizing dyes, used according to the present invention, results in exposures to obtain optical densities of $D_{min}$+0.5 of between 100% and 712% of the exposures required by photothermographic materials only differing in the omission of the dilithium salt of 2,2'-disulfo-4,4'-bis[2-{4,6-bis(2-oxy-naphtho)}-triazino]-aminostilbene. This demonstrates the unexpected IR-sensitization properties of the dyes used according to the present invention in photothermographic recording materials comprising a photo-addressable thermally developable element coated from aqueous media.

Having described in detail preferred embodiments of the current invention, it will now be apparent to those skilled in the art that numerous modifications can be made therein without departing from the scope of the invention as defined in the following claims.

We claim:

1. A process for producing a photothermographic recording material, having a support and a photo-addressable thermally developable element containing a substantially light-insensitive organic silver salt, a reducing agent therefor in thermal working relationship therewith, photosensitive silver halide spectrally sensitized to wavelengths >700 nm with a dye and in catalytic association with said substantially light-insensitive organic silver salt and a water-soluble binder, a water-dispersible binder or a mixture of a water-soluble and a water-dispersible binder, comprising the steps of: (i) producing an aqueous dispersion or aqueous dispersions containing said substantially light-insensitive organic silver salt, said photosensitive silver halide spectrally sensitized to infra-red light with said dye, said reducing agent and said water-soluble binder, water-dispersible binder or mixture of a water-soluble and a water dispersible binder; and (ii) coating said aqueous dispersion or aqueous dispersions onto a support, wherein said photothermographic recording material has an infra-red sensitivity of less than 20 J/m² and said dye corresponds to formula I:

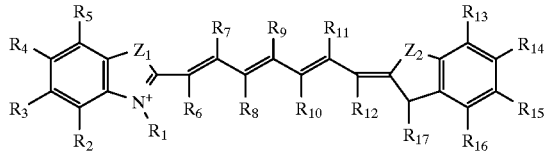

with an anion if necessary for charge compensation, wherein $Z^1$ and $Z^2$ independently represent S, O or Se: $R^1$ and $R^{17}$ are independently each an alkyl substituted with at least one fluorine, chlorine, bromine, iodine or an aryloxy-, alkoxy-, —(C=O)—R, —(S=O)—R', —($SO_2$)—R' group, where R is an alkoxy, aryloxy, amino or substituted amino group and R' is a hydroxy, mercapto, alkoxy, aryloxy, amino or substituted amino group: $R^2$, $R^3$, $R^4$, $R^5$, $R^{13}$, $R^{14}$, $R^{15}$ and $R^{16}$ are independently each hydrogen chlorine, bromine, fluorine or a keto-, sulfo-, carboxy-, ester-, sulfonamide-, amide-, dialkylamino-, nitro-, cyano-, alkyl-, alkenyl-, heteroaromatic, aryl-, alkoxy- or aryloxy-group, which groups may be substituted: or each of $R^2$ together with $R^3$, $R^3$ together with $R^4$, $R^4$ together with $R^5$, $R^{13}$ together with $R^{14}$, $R^{14}$ together with $R^{15}$ and $R^{15}$ together with $R^{16}$ may independently constitute the atoms necessary to complete a benzene ring which may be substituted; $R^6$, $R^7$, $R^8$, $R^9$, $R^{10}$, $R^{11}$ and $R^{12}$ independently represent hydrogen, an alkyl group, a substituted alkyl group, an alkoxy group, an aryloxy group, a thioalkyl group, a thioaryl group, chlorine, fluorine, bromine, iodine, a disubstituted amino group, wherein the substituents may constitute the atoms necessary to complete a 5-ring atom or 6-ring atom heterocyclic ring, or each of $R^6$ together with $R^8$, $R^8$ together with $R^{10}$, $R^{10}$ together with $R^{12}$, $R^7$ together with $R^9$ and $R^9$ together with $R^{11}$ may independently constitute the atoms necessary to complete a 5-atom or 6-atom carbocyclic or heterocyclic ring which may be substituted: and each of $R^1$ together with $R^6$ and $R^{12}$ together with $R^{17}$ may independently constitute the atoms necessary to complete a 5-atom or 6-atom heterocyclic ring which may be substituted, and wherein said dye satisfies the following test: a photothermographic recording material A, consisting of a polyester 100 μm thick support provided with a photo-addressable thermally developable element produced as follows:

i) a coating dispersion is produced by adding with stirring the following ingredients to a stabilized aqueous dispersion of finely divided silver behenate at a pH of 6.5; 3 - (triphenyl - phosphonium) propionic acid bromide in a quantity corresponding to 8 mol % with respect to the silver behenate in the dispersion as an aqueous solution with a pH of 4 followed by at least 10 minutes stirring;

a supersensitizer being the dilithium salt of 2,2' disulfo-4, 4'-bis[2- {4, 6- bis (2 - oxy - naphtho)}- triazino]-aminostilbene corresponding to the formula

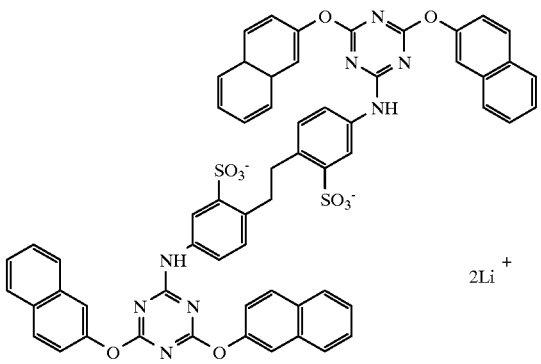

if appropriate, as a solution in methanol:

said dye as a solution or dispersion in water and/or methanol followed by at least 15 minutes stirring;

a film-forming non-proteinaceous binder in a quantity equal in weight to the silver behenate in the dispersion as an aqueous solution or dispersion with a pH of 4; and 3 - (3', 4'- dixhydroxyphenyl) propionic acid in a quantity of 40 mol % with respect to the silver behenate in the dispersion as an aqueous solution;

ii) the dispersion is then coated onto a subbed 100 $\mu$m thick polyethylene terephthalate support and dried to yield a coating weight of silver behenate of approximately 4.5 g/m$^2$;

wherein said photothermographic recording material A requires an exposure >90% of an exposure required by a photothermographic recording material B produced as described for said photothermographic recording material A except that said supersensitizer [dilithium salt of 2,2'-disulfo-4,4'-bis [2-{4,6-bis(2-oxy-naphtho)}-triazine]-aminostilbene] is omitted, and said exposure of said materials A and B being that required to obtain an optical density in an exposed part thereof 0.5 higher than in an non-exposed part thereof when exposed to infra-red light to which it is sensitive and heating with a heat source at 105° C. for 15 s with said polyester support thereof in contact with said heat source.

2. The process according to claim 1, wherein said photothermographic recording material has an infra-red sensitivity of less than 8 J/m$^2$.

3. The process according claim 1, wherein said dye corresponds to the formula

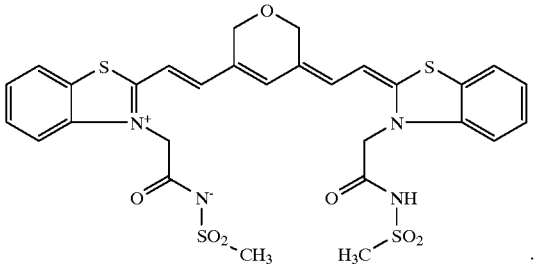

4. The process according material according to claim 1, wherein said dye corresponds to the formula

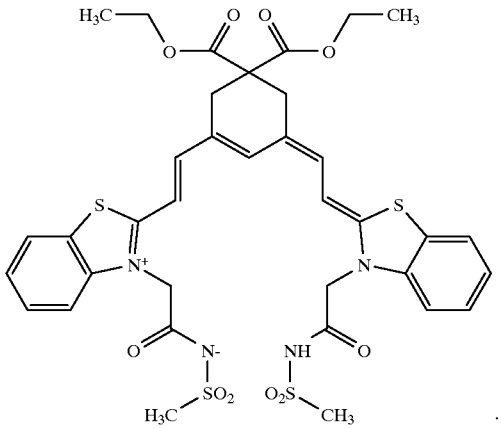

5. The process according to claim 1, wherein said dye corresponds to the formula

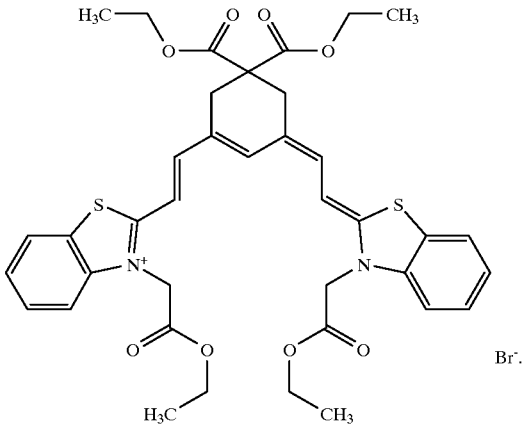

* * * * *

UNITED STATES PATENT AND TRADEMARK OFFICE

CERTIFICATE OF CORRECTION

PATENT NO. : 5,958,667
DATED : September 28, 1999
INVENTOR(S) : Deroover et al.

It is certified that error appears in the above-identified patent and that said Letters Patent is hereby corrected as shown below:

Column 1,
Line 4, "The" should read -- This --; and "claim" should read -- claims --;

Column 2,
Line 54, "$(CH_2)_n$—COO" should read -- $(CH_2)_n$—$COO^-$ --;

Column 19,
SENSI C02,

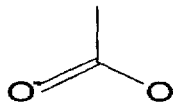

should read

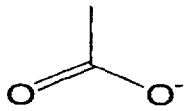

Column 19,
SENSI C02:

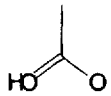

should read

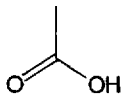

Column 19,
SENSI C03:

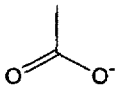

should read

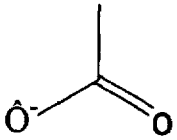

UNITED STATES PATENT AND TRADEMARK OFFICE

CERTIFICATE OF CORRECTION

PATENT NO. : 5,958,667
DATED : September 28, 1999
INVENTOR(S) : Deroover et al.

It is certified that error appears in the above-identified patent and that said Letters Patent is hereby corrected as shown below:

Column 24,
Line 40, "owed" should read -- followed --;

Column 28,
Line 33, "hydrogen chloride," should read -- hydrogen, chloride, --;
Lines 37 and 51, "substituted:" should read -- substituted; --;
Line 55, "substituted," should read -- substituted; --;
Line 62, "6.5;" should read -- 6.5: --;

Column 29,
Lines 40-42, "[dilithium salt....etc." through "...aminostilbene]" should be deleted.

Signed and Sealed this

Eleventh Day of December, 2001

*Attest:*

Nicholas P. Godici

*Attesting Officer*

NICHOLAS P. GODICI
*Acting Director of the United States Patent and Trademark Office*